US006080098A

United States Patent [19]

Borgström et al.

[11] Patent Number: 6,080,098

[45] Date of Patent: Jun. 27, 2000

[54] METHOD AND A DEVICE FOR INTERNAL CLEANING OF A CENTRIFUGAL ROTOR, AND A CENTRIFUGAL SEPARATOR EQUIPPED WITH A DEVICE OF THIS KIND

[75] Inventors: Leonard Borgström, Tyresö; Patrik Brehmer, Täby; Claes-Göran Carlsson; Peter Franzén, both of Tullinge; Claes Inge, Saltsjö-Duvnäs; Torgny Lagerstedt, Stockholm; Hans Moberg, Stockholm; Stefan Szepessy, Stockholm, all of Sweden

[73] Assignee: Alfa Laval AB, Lund, Sweden

[21] Appl. No.: 09/068,380

[22] PCT Filed: Nov. 5, 1996

[86] PCT No.: PCT/SE96/01418

§ 371 Date: May 8, 1998

§ 102(e) Date: May 8, 1998

[87] PCT Pub. No.: WO97/17139

PCT Pub. Date: May 15, 1997

[30] Foreign Application Priority Data

Nov. 9, 1995 [SE] Sweden ..... 9503965

[51] Int. Cl.[7] ..... B04B 1/08; B04B 15/06

[52] U.S. Cl. ..... 494/27; 494/37; 494/70

[58] Field of Search ..... 494/23, 27–30, 494/37, 56, 68–70; 210/209–211

[56] References Cited

U.S. PATENT DOCUMENTS

| | | | |
|---|---|---|---|
| 2,564,899 | 8/1951 | Harstick | 494/30 |
| 2,575,506 | 11/1951 | Acton | 494/30 |
| 2,603,413 | 7/1952 | Orelind | 494/27 |
| 2,629,547 | 2/1953 | Orelind | 494/27 |
| 2,906,449 | 9/1959 | Sullivan | 494/30 |
| 4,871,349 | 10/1989 | Tenthoff | 494/56 |
| 5,104,371 | 4/1992 | Ajnefors | 494/70 |

FOREIGN PATENT DOCUMENTS

| | | |
|---|---|---|
| 3041 210 | 5/1982 | Germany . |
| WO 94/06565 | 3/1994 | WIPO . |

*Primary Examiner*—Charles E. Cooley
*Attorney, Agent, or Firm*—Fish & Richardson P.C.

[57] ABSTRACT

In a centrifugal rotor there is an inlet chamber (7), a separation chamber (8) and an outlet chamber (10), which chambers are coupled in series. A stationary outlet member (16) is arranged to remove from a predetermined level in the outlet chamber (10) separated liquid during normal operation of the centrifugal rotor. For internal cleaning of the centrifugal rotor there is arranged within the outlet chamber (10) inside said predetermined radial level a preferably stationary reconducting member (26) that is dimensioned to accomplish a recirculation flow of cleaning liquid through said chambers (7, 8, 10) in the centrifugal rotor, which circulation flow is substantially larger than the flow of liquid which during normal operation of the centrifugal rotor passes through these chambers.

12 Claims, 2 Drawing Sheets

METHOD AND A DEVICE FOR INTERNAL CLEANING OF A CENTRIFUGAL ROTOR, AND A CENTRIFUGAL SEPARATOR EQUIPPED WITH A DEVICE OF THIS KIND

FIELD OF THE INVENTION

A method and a device for internal cleaning of a centrifugal rotor, and a centrifugal separator equipped with a device of this kind. The present invention relates to a method and a device for internal cleaning of a centrifugal rotor, which is rotatable around a center axis and delimits in its interior an inlet chamber for receiving a liquid to be treated in the centrifugal rotor, a separation chamber communicating with the inlet chamber and at least one outlet chamber communicating with the separation chamber. The invention also relates to a centrifugal separator having a rotor of the kind just defined and a device for internal cleaning thereof.

BACKGROUND OF THE INVENTION

More particularly, in this connection, a centrifugal rotor is concerned which is included in a centrifugal separator comprising also an inlet device, which has an inlet channel and is arranged during normal operation of the centrifugal separator to supply into the inlet chamber through the inlet channel a predetermined flow of said liquid to be treated in the centrifugal rotor, and an outlet device which has at least one outlet channel and is arranged during normal operation of the centrifugal separator to discharge through the outlet channel a separated liquid from a first radial level in the outlet chamber out of the centrifugal rotor. Furthermore, the centrifugal separator comprises for internal cleaning of the centrifugal rotor a cleaning device including means for supply of a cleaning liquid to the interior of the centrifugal rotor, means for enabling movement of a liquid surface, formed within the outlet chamber at said first radial level during rotation of the centrifugal rotor, in a direction towards the center axis of the centrifugal rotor and at least one reconducting member, which delimits at least one reconducting channel having two ends and which is formed to be placed such that the reconducting channel opens with its one end in the outlet chamber at a second radial level, that is situated between the center axis of the centrifugal rotor and said first radial level, and opens with its other end in the inlet chamber.

A centrifugal separator of this kind is described in DE-30 41 210-C2. In this known centrifugal separator the reconducting member is intended and formed particularly for enabling cleaning of certain central parts of the centrifugal rotor, which are situated in the area of the inlet device extending into the inlet chamber. The reconducting member, is not, however, intended or formed for enabling cleaning of other parts of the centrifugal rotor, e.g. parts delimiting the main part of the inlet chamber, the separation chamber and the outlet chamber. For cleaning of these other parts of the centrifugal rotor use is instead made of the ordinary outlet device for liquid having been separated in the centrifugal rotor. Thus, a cleaning liquid is conducted during the cleaning operation out of the outlet chamber through the outlet channel and then again into the centrifugal rotor through said inlet channel. The recirculation flow of cleaning liquid through the outlet and inlet channels is then substantially larger than the flow of cleaning liquid passing through the reconducting channel.

For accomplishing an effective cleaning of the inlet, separation and outlet chambers of the rotor it is important that the flow of cleaning liquid through the centrifugal rotor is large. Thus, sometimes such a flow of cleaning liquid has to be several times larger than the flow of liquid flowing through the centrifugal rotor during the normal-use thereof. By means of an arrangement of the kind described in DE-30 41 210-C2 it is certainly possible to accomplish a relatively large circulation flow of cleaning liquid through the centrifugal rotor. A precondition for this is only that the outlet and inlet devices used for the recirculation are dimensioned for such a large circulation flow. However, this is not normally the case in practice, and the background thereof is the following.

It is important that an outlet device of the kind here in question is dimensioned with regard to the size of the flow for which it is intended. The outlet device, which is partly constituted by a stationary member freely suspended within the rotating centrifugal rotor and which together with the centrifugal rotor forms a pump, thus should not be overdimensioned, i.e. be given a too large flow capacity. If, namely, at normal rotational speed of the centrifugal rotor, the outlet device is used for a flow that is much smaller than the flow for its maximum capacity, there will come up undesired flow phenomena within and around the outlet device in the centrifugal rotor. These can lead to vibrations of the outlet device and, in the worst case, also influence the centrifugal rotor to perform swinging motions.

This means that circulation flow cleaning of a centrifugal rotor, as such cleaning has been described in DE-30 41 210-C2, can normally be formed in practice only by means of a circulation flow having the same magnitude as, or being insignificantly larger than, the flow through the centrifugal rotor at its normal use, since the outlet device is not normally dimensioned for a flow substantially larger than that.

Furthermore, if in an arrangement according to DE-30 41 210-C2 a circulation flow several times larger than the normal flow through the outlet device should be possible, also those parts of the outlet device situated outside the centrifugal rotor would have to be dimensioned for a substantially larger flow than they normally are.

For avoiding the disadvantages connected with conventional circulation flow cleaning in accordance with DE-30 41 210-C2, an arrangement in accordance with DE-38 02 306 could be used instead. An arrangement of this kind requires, however, that the centrifugal rotor is stopped after the finished separating operation and that, among other things, parts of the centrifugal rotor are exchanged, after which circulation flow cleaning of the centrifugal rotor can be beformed by means of a special recirculation member dimensioned with regard to a desired circulation flow of cleaning liquid. An arrangement of this kind has obvious disadvantages and is not suitable in a process industry having requirements on automatically beformable cleaning operations without need of manual handling of the centrifugal rotor.

SUMMARY OF THE INVENTION

The present invention has for its object to provide a method and a device for effective cleaning of the interior of a centrifugal rotor without the centrifugal rotor having to be stopped and without the outlet device having to be overdimensioned with regard to the liquid flow to be conducted out of the centrifugal rotor during normal use thereof.

This object can be fulfilled in accordance with the invention by using said reconducting member to generate a circulation flow of cleaning liquid through the reconducting channel, the inlet chamber, the separation chamber and the outlet chamber, which circulation flow is substantially larger than said predetermined flow of liquid supplied into the inlet chamber through the inlet channel during normal operation of the centrifugal separator.

A cleaning device according to the invention is characterized in that the reconducting channel in the reconducting member has a flow capacity that is so large that—when cleaning liquid fills up the outlet chamber to a third radial level situated between the center axis of the centrifugal rotor and said second radial level the reconducting channel will transfer a flow of cleaning liquid from the outlet chamber to the inlet chamber, which is substantially larger than, prefably at least twice as large as, said predetermined flow of separated liquid through the outlet channel during normal operation of the centrifugal separator.

Thanks to the invention it is now possible by simple means to clean the interior of a centrifugal rotor by means of a circulation flow several times larger than the flow through the centrifugal rotor during the normal use thereof, and in spite of this to use an outlet device which is optimally dimensioned for a flow of separated liquid to be conducted out of the rotor during normal operation thereof.

If desired, part of the cleaning liquid entering the outlet chamber may be conducted out thereof through the previously mentioned outlet channel, whereas the rest of the cleaning liquid is reconducted into the inlet chamber. In this case new cleaning liquid is supplied preferably continuously to the inlet chamber in the same amount as already used cleaning liquid is discharged through the outlet channel. Preferably, however, substantially all of the cleaning liquid passing through the inlet chamber, the separation chamber and the outlet chamber is recirculated by means of the reconducting member during at least part of a cleaning operation.

The movement of the liquid surface in the outlet chamber radially inwardly from said first to said third level, which is necessary for a cleaning operation, may be accomplished in any suitable manner. If a so called paring disc is used for the discharge of separated liquid from the outlet chamber, the movement can be accomplished by strong throttling or complete stopping of an outflow through this paring disc. Alternatively, if instead of said paring disc a radially movable outlet member is used, this outlet member, i.e. virtually the outlet for liquid from the outlet chamber, may be moved towards the rotor center axis.

The present invention also concerns a centrifugal separator having a rotor and a device as defined above for internal cleaning of the rotor.

BRIEF DESCRIPTION OF THE DRAWINGS

One embodiment of the invention is described in the following with reference to the accompanying drawing, in which FIG. 1 schematically shows a centrifugal rotor in an axial section.

DETAILED DESCRIPTION

Figure 1:
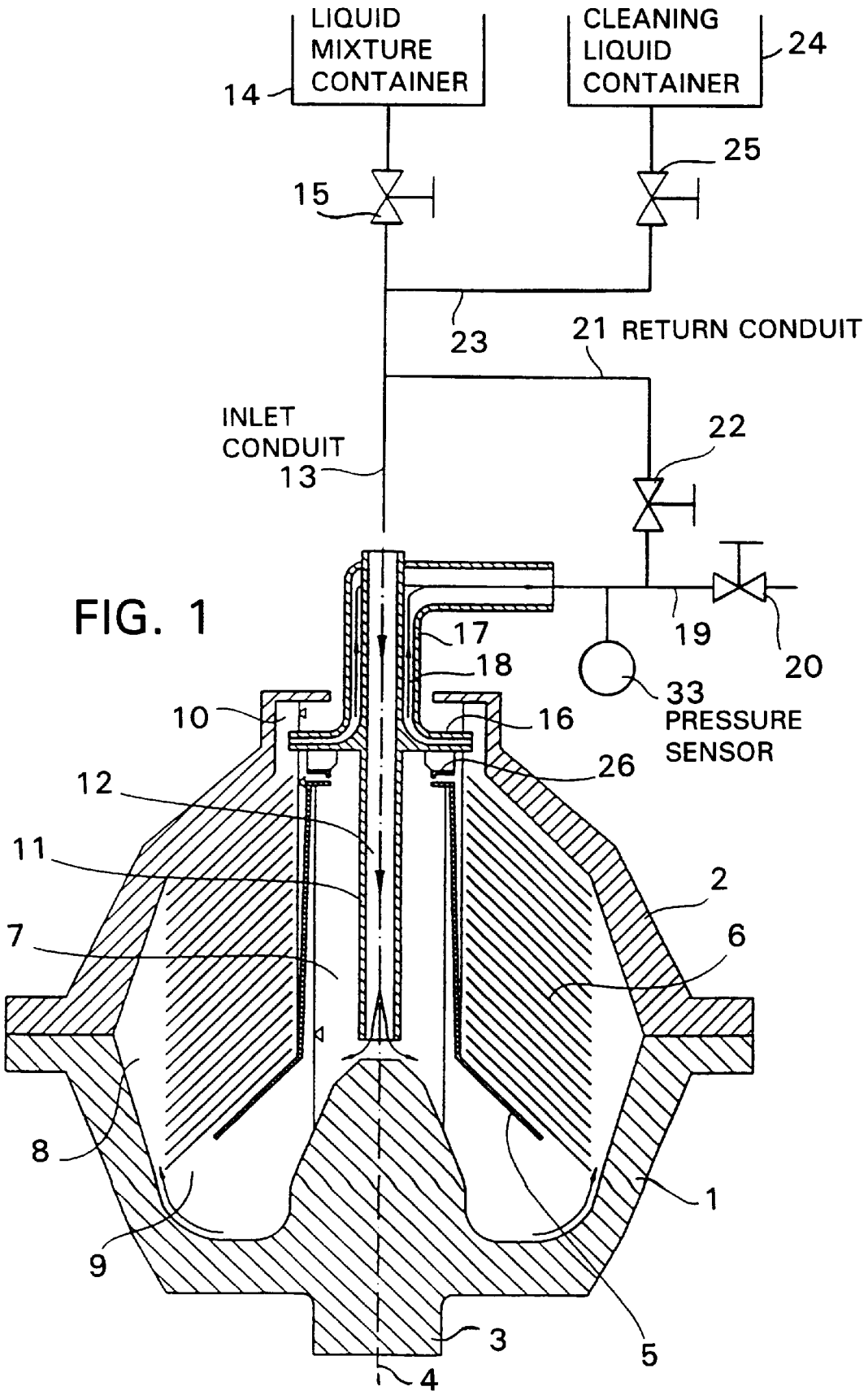

FIG. 1 shows a centrifugal rotor intended for centrifugation of a mixture consisting of a liquid and particles suspended therein, which have a density larger than that of the liquid. The centrifugal rotor copmrises a lower rotor part 1 and connected therewith an upper rotor part 2. The rotor is supported at the top of a vertical drive shaft 3 (only a part of which is shown) and is rotable around a center axis 4 by means of a motor (not shown) coupled to the driving shaft 3. Within the rotor there is mounted for rotation therewith a distributor 5 and extending therearound a stack of frustoconical separation discs 6.

Centrally within the rotor the distributor 5 delimits an inlet chamber 7, and around the distributor 5 there is delimited a separation chamber 8, in which the stack of separation discs 6 is arranged. The inlet chamber 7 communicates with the separation chamber 8 through a passage 9 between the distributor 5 and the the lower rotor part 1.

Above the distributor 5 the upper rotor part 2 delimits an outlet chamber 10 which communicates with the separation chamber 8.

There extends into the rotor from above a stationary inlet pipe 11 which forms an inlet channel 12 opening into the inlet chamber 7. The inlet pipe 11 is connected with an inlet conduit 13, which starts from a container 14 intended for a liquid mixture to be treated in the rotor. In the inlet conduit 13 there is inserted a closing valve 15.

In the area of the outlet chamber 10 in the rotor the inlet pipe 11 supports and annular so called paring disc 16, which extends radially outwardly in the outlet chamber 10. On its upper side the paring disc 16 is connected with an outlet pipe 17, which surrounds a part of the inlet pipe 11 and, above the rotor, extends perpendicularly to the inlet pipe 11. The paring disc 16 and the outlet pipe 17 delimit an outlet channel 18 for separated liquid. In practice, the outlet channel 18, at least within the paring disc 16, is constituted by several passages opening in the outlet chamber 10 at the radial level of the paring disc circumference. The outlet pipe 17 is connected with an outlet conduit 19, in which there is inserted a controllable throttle and closing valve 20.

Through a return conduit 21, in which there is inserted a closing valve 22, the outlet conduit 19 communicates with the inlet conduit 13 downstream of the valve 15. To the inlet conduit 13 there is also connected through a conduit 23 a container 24 for cleaning liquid. The conduit 23 is provided with a closing valve 25 and is connected to the inlet conduit 13 between the valve 15 and the return conduit 21.

On its underside the paring disc 16 supports a reconducting member in the form of a further paring disc 26, which has a substantially smaller outer diameter than the paring disc 16. The paring disc 26 comprises several plates 27 (FIG. 3), which between themselves form passages 28. The passages 28 extend from openings 29 at a certain radial level in the outlet chamber 10 helically inwardly towards the rotor center axis 4 and open into an annular channel 30 (FIG. 2), which is formed around the inlet pipe 11 between this and the paring disc 26. The annular channel 30 opens into the upper part of the inlet chamber 7.

Figure 2:
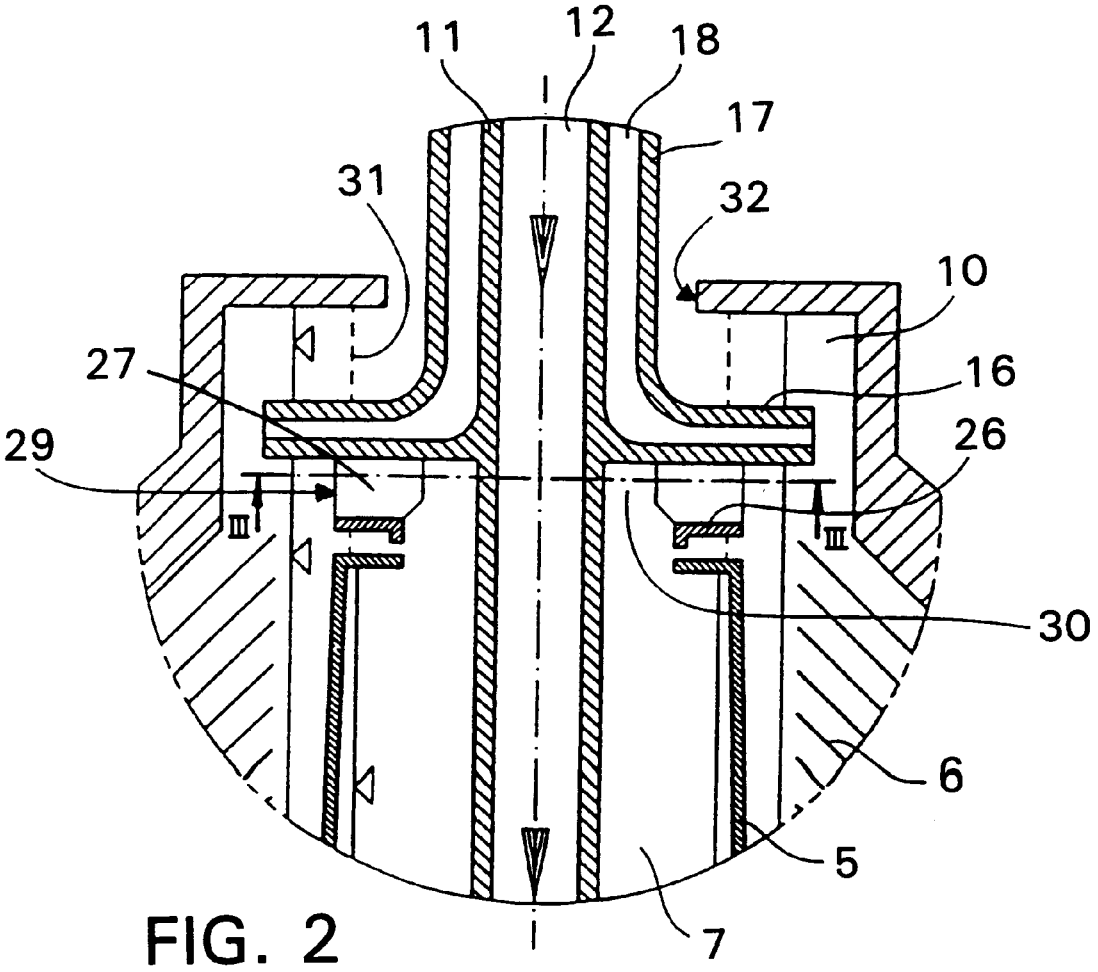
FIG. 2 shows an enlarged part of FIG. 1

FIGS. 1 and 2 show by means of small triangles the radial levels at which free liquid surfaces are formed in the various chambers of the rotor during normal operation of the centrifugal separator. By means of a dotted line 31 there is shown in FIG. 2 a radial level, at which a free liquid surface is formed in the outlet chamber 10 during an operation for internal cleaning of the rotor. As can be seen, this level, i.e. the line 31, is situated radially inside of the openings 29 of the passages 28 in the outlet chamber 10 and radially outside of an edge 32 of the upper rotor part 2, which edge extends around the outlet pipe 17 above the paring disc 16.

All of the valves 15, 20, 22 and 25 are connected to and are automatically controllable by means of a programmable control unit (not shown). To this control unit is also connected a pressure sensor 33 inserted in the outlet conduit 19 upstream of the valve 20.

Figure 3:
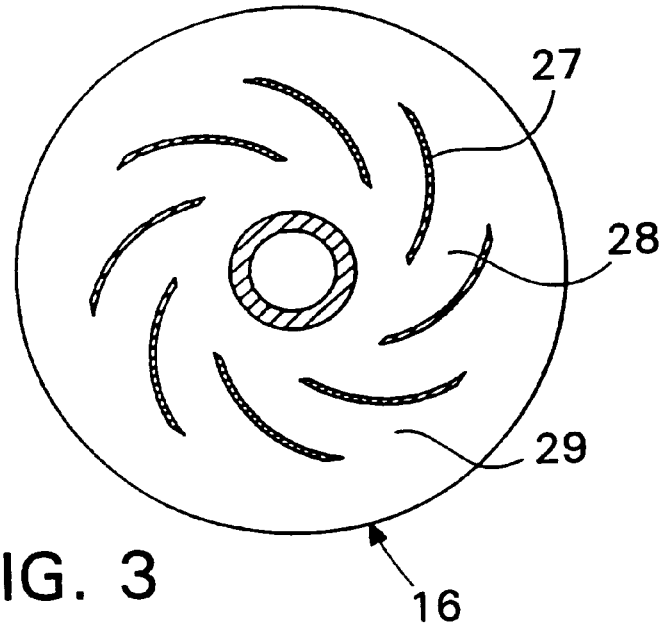
FIG. 3 shows a section along the line III—III in FIG. 2.

The centrifugal separator according to FIGS. 1–3 is intended to operate in the following manner.

When the rotor has been brought in rotation around its center axis 4, the valve 15 is opened so that mixture to be centrifugated flows through the conduit 13 and the inlet channel 12 into the inlet chamber 7. At this stage the valves 22 and 25 are closed but the valve 20 is open. From the inlet chamber 7 the mixture flows further through the passage 9 into the separation chamber 8, in which its flows radially inwardly in thin interspaces between the separation discs 6. In these interspaces the particles are separated from the liquid, after which the particles move radially outwardly and the separated liquid further radially inwardly. The particles leave said interspaces and are collected in the radially outermost part of the separation chamber 8, whereas the liquid having been freed from particles flows from the radially inner parts of the interspaces axially upwardly and into the outlet chamber 10. Through the outlet channel 18 in the paring disc 16 and the outlet pipe 17 the separated liquid is pumped out through the conduit 19 past the completely open valve 20.

For maintenance of the free liquid surface in the outlet chamber 10 at the radial level shown in the drawing there can be arranged in the conduit 19 downstream of the valve 20 a so called constant pressure valve, which is adjustable so that it maintains a predetermined pressure in the conduit 19 even if the liquid flow therethrough varies within certain limits.

Upon need separated particles may be removed intermittently from the separation chamber 8 during rotation of the rotor through a number of closable sludge outlet channels (not shown), which extend through the surrounding wall of the rotor in the area of the radially outermost part of the separation chamber. The rotor is for this purpose equipped with a discharge mechanism of some suitable kind (not shown). Discharge mechanisms for this particular purpose are well known to people skilled in the art and form no part of the present invention.

After some time of separation of liquid and particles the centrifugal rotor may need to be cleaned internally, the following operation being performed automatically according to a program stored in the previously mentioned control unit (not shown). The operation is performed while the rotor is kept in rotation.

First, the valve 15 is closed, whereafter the separation chamber 8 is emptied of particles as well as of liquid through said sludge outlet channels in the surrounding wall of the rotor (not shown). After this the valve 20 is closed and the valve 25 is opened, so that cleaning liquid may flow from the container 24 through the conduits 23 and 13 and the inlet channel 12 into the rotor. When the rotor is almost completely filled up, cleaning liquid is beginning to be pumped out through the outlet channel 18 to the conduit 19, which is filled up to the valve 20. The free liquid surface in the outlet chamber 10 thereafter moves radially inwardly to the level 31 (FIG. 2), i.e. a small distance radially inside of the circumference of the paring disc 26.

At this stage the valve 25 is closed, which can be made automatically after a predetermined liquid pressure has been obtained and is sensed in the outlet conduit 19 by means of the pressure sensor 33. Already before this occurs, pumping of cleaning liquid out of the outlet chamber 10 and into the inlet chamber 7 by means of the paring disc 26 has started. This means that cleaning liquid is beginning to be pumped around in a circuit comprising the inlet chamber 7, the separation chamber 8 and the outlet chamber 10. The flow, or quantity in this circuit increases gradually, until it is interrupted or a limit for the same is obtained. This limit can be set either by the flow capacity of one of the passages 28, the annular channel 30 or some other passage in said circuit, or by the capacity of the motor driving the centrifugal rotor. That the capacity of this motor may be decisive depends upon the fact that the circulating cleaning liquid, all the time, has to be brought into a renewed rotational movement by means of the rotor on its way through the inlet chamber 7. Whereas the motor, as a rule, is dimensioned for a certain flow of mixture from the container 14, which flow is limited with regard to the separation ability of the centrifugal rotor at a predetermined rotational speed of the rotor, the circulation flow, or quantity of cleaning liquid may be increasing so that it becomes several times as large as the normal flow of mixture from the container 14. For an effective cleaning of the rotor interior it is thus important that said motor has a sufficiently large capacity for a desired size of the circulation flow of cleaning liquid.

During the circulation of cleaning liquid the free liquid surface formed in the inlet chamber 7 will initially move a distance radially inwardly. Possibly it may move so far inwardly that part of the cleaning liquid flows directly out into the outlet chamber 10 through the passage formed between the distributor 5 and the paring disc 26, and then even the surfaces delimiting this passage will be cleaned.

If desired, the valve 20 during the whole or part of the cleaning operation may be set in a way such that part of the cleaning liquid leaves the centrifugal rotor through the outlet conduit 19. In this case new cleaning liquid has to be added continuously or intermittently to the centrifugal rotor from the container 24. Such supply of new cleaning liquid may be accomplished by opening and closing of the valve 25 by guidance of the pressure sensed in the outlet conduit 19 by means of the pressure sensor 33. This pressure is dependent on the radial level at which the free liquid surface in the outlet chamber 10 is situated.

Upon need the valve 22 during part of a cleaning operation may be opened for accomplishing a strong flow of cleaning liquid through the inlet conduit 13 and the inlet pipe 11. After a finished cleaning operation the centrifugal rotor may be emptied of cleaning liquid through the previously mentioned sludge outlet channels through the circumferential wall of rotor.

Instead of the valves 15 and 25 a three-way valve may be arranged where the conduit 23 is connected to the inlet conduit 13. Further, the valve 22 may be substituted for a three-way valve either where the return conduit 21 is connected to the inlet conduit 13 or where the return conduit 21 is connected to the outlet conduit 19.

It has been described above that during the first part of a cleaning operation the liquid surface in the outlet chamber 10 is moved radially inwardly by throttling or stopping of a flow through the outlet conduit 19 by means of the valve 20.

An alternative way in which the movement of the liquid surface in the outlet chamber 10 can be accomplished is that a tubular or differently formed paring member, used in stead of the paring disc 16, is moved in a direction towards the rotor center axis, i.e. that the liquid outlet from the outlet chamber 10 is moved radially inwardly. A paring member movable in this way is known for instance from WO94/06565.

A device of the kind described here for internal cleaning of a centrifugal rotor can be used, of course, even for a centrifugal rotor having two or more outlet chambers similar to the outlet chamber 10. Then it may often be enough that one of the outlet chambers is included in the circuit, through which cleaning liquid is circulated. However, it is possible to arrange a reconducting member, similar to the paring disc 26, in each one of several such outlet chambers. Preferably, these reconducting members have substantially the same outer diameter, i.e. their reconducting channels open with their one ends in the respective outlet chambers at substantially one and the same radial level. All of such reconducting channels may open with their opposite ends in the inlet chamber of the centrifugal rotor and, thus, commonly contribute to a desired circulation flow of cleaning liquid through the various chambers of the centrifugal rotor. Alternatively, several, e.g. two, outlet chambers of this kind may be coupled in series, i.e. a first reconducting member may be arranged to conduct cleaning liquid from the first to the second outlet chamber, whereas a second reconducting member may be arranged to conduct cleaning liquid further from the second outlet chamber to the inlet chamber of the rotor. In the last mentioned case it may be possible that the first reconducting member would need to have a larger outer diameter than the second reconducting member.

What is claimed is:

1. A method of internal cleaning of a centrifugal rotor, which rotates around a center axis (4) and delimits in its interior an inlet chamber (7) for receiving a liquid to be treated in the centrifugal rotor, a separation chamber (8) communicating with the inlet chamber (7) and at least one outlet chamber (10) communicating with the separation chamber (8), and which centrifugal rotor is included in a centrifugal separator also having an inlet device, which has an inlet channel (12) and is arranged during normal operation of the centrifugal separator to supply into the inlet chamber (7) through the inlet channel (12) a predetermined quantity of said liquid to be treated in the centrifugal rotor, an outlet device, which has at least one outlet channel (18) and is arranged during normal operation of the centrifugal separator to discharge through the outlet channel (18) a separated liquid from a first radial level in the outlet chamber (10) out of the centrifugal rotor, and at least one reconducting member (26), which delimits at least one reconducting channel (28, 30) having two ends and which is formed to be placed such that the reconducting channel (28, 30) opens with its one end (28) in the outlet chamber (10) at a second radial level (29), that is situated between the centrifugal rotor center axis (4) and said first radial level, and opens with its other end (30) in the inlet chamber (7), and cleaning liquid for said cleaning being supplied to the centrifugal rotor interior, a liquid surface formed in the outlet chamber (10) being caused to move towards said center axis (4) to said second radial level (29) and a flow of cleaning liquid being generated by means of the reconducting member (26) from the outlet chamber (10) through the reconducting channel (28, 30) to the inlet chamber (7), said method comprising using the reconducting member (26) to generate a circulation quantity of cleaning liquid through the reconducting channel (28, 30), the inlet chamber (7), the separation chamber (8) and the outlet chamber (10), which circulation quantity is substantially larger than said predetermined quantity of liquid supplied into the inlet chamber (7) through the inlet channel (12) during normal operation of the centrifugal separator.

2. A method according to claim 1, in which substantially all cleaning liquid flowing through the inlet chamber (7), the separation chamber (8) and the outlet chamber (10) is recirculated by means of the reconducting member (26).

3. A method according to claim 1, in which the reconducting member (26) recirculates a quantity of liquid that is at least twice as large as said predetermined quantity of liquid which during normal operation of the centrifugal separator is supplied to the centrifugal rotor through the inlet channel (12).

4. A method according to claim 1, in which the liquid surface in the outlet chamber (10) is caused to move towards the centrifugal rotor center axis (4) by throttling or completely stopping the cleaning liquid outflow through the outlet channel.

5. A method according to claim 1, in which the liquid surface in the outlet chamber (10) is caused to move towards the centrifugal rotor center axis (4) by moving at least a part of the outlet device in a direction towards said center axis (4), which blocks a part of the outlet channel (18).

6. A cleaning device for internal cleaning of a centrifugal rotor, which is rotatable around a center axis (4) and delimits in its interior an inlet chamber (7) for receiving a liquid to be treated in the centrifugal rotor, a separation chamber (8) communicating with the inlet chamber (7) and at least one outlet chamber (10) communicating with the separation chamber (8), and which centrifugal rotor is included in a centrifugal separator also having an inlet device, which has an inlet channel (12) and is arranged during normal operation of the centrifugal separator to supply into the inlet chamber (7) through the inlet channel (12) a predetermined quantity of said liquid to be treated in the centrifugal rotor, and an outlet device, which has at least one outlet channel (18) and is arranged during normal operation of the centrifugal separator to discharge through the outlet channel a separated liquid from a first radial level in the outlet chamber (10) out of the centrifugal rotor, said cleaning device comprising means (23–25) for supply of cleaning liquid to the interior of the centrifugal rotor, means (20) for enabling a movement in the direction towards the centrifugal rotor center axis (4) of a liquid surface formed in the outlet chamber (10) at said first radial level during rotation of the centrifugal rotor, and at least one reconducting member (26), which delimits at least one reconducting channel (28, 30) having two ends and which is formed to be placed such that the reconducting channel opens with its one end (28) in the outlet chamber (10) at a second radial level (29), that is situated between the centrifugal rotor center axis (4) and said first radial level, and opens with its other end (30) in the inlet chamber (7), wherein the reconducting channel (28, 30) in the reconducting member (26) has a flow capacity such that when cleaning liquid fills up the outlet chamber (10) to a third radial level situated between the centrifugal rotor center axis (7) and said second radial level, the reconducting channel (28, 30) will transfer a quantity of cleaning liquid from the outlet chamber (10) to the inlet chamber (7), substantially larger than said predetermined quantity of separated liquid through the outlet channel (18) during normal operation of the centrifugal separator.

7. A cleaning device according to claim 6, in which the reconducting channel (28,30) has a through flow area which is larger than that of said outlet channel (18).

8. A cleaning device according to claim 6, in which the reconducting channel (28,30) has a through flow area which is larger than that of said inlet channel (12).

9. A cleaning device according to claim 6, in which part (30) of the reconducting channel is annular and surrounds said inlet channel (12).

10. A cleaning device according to claims 6, in which the reconducting channel (28,30) at least in its part situated in the outlet chamber (10) is divided in several passages (28), which have separate openings (29) in the outlet chamber (10) at said second radial level.

11. A cleaning device according to claim 6, in which the reconducting member (26) is situated completely within the centrifugal rotor and is supported therein by said inlet device.

12. A centrifugal separator comprising a centrifugal rotor, which is rotatable around a center axis (4) and delimits in its interior an inlet chamber (7) for receiving a liquid to be treated in the centrifugal rotor, a separation chamber (8) communicating with the inlet chamber (7) and at least one outlet chamber (10) communicating with the separation chamber (8), an inlet device, which has an inlet channel (12) and is arranged during normal operation of the centrifugal separator to supply into the inlet chamber (7) through the inlet channel (12) a predetermined quantity of said liquid to be treated in the centrifugal rotor, and an outlet device, which has at least one outlet channel (18) and is arranged during normal operation of the centrifugal separator to discharge through the outlet channel a separated liquid from a first radial level in the outlet chamber (10) out of the centrifugal rotor, wherein the centrifugal separator further comprises a cleaning device for internal cleaning of the centrifugal rotor, as defined in claim 6.

* * * * *

UNITED STATES PATENT AND TRADEMARK OFFICE
CERTIFICATE OF CORRECTION

PATENT NO. : 6,080,098

DATED : JUNE 27, 2000

INVENTOR(S) : BORGSTROM ET AL.

It is certified that error appears in the above-identified patent and that said Letters Patent is hereby corrected as shown below:

Col. 2, line 48, change "be beformed" to --be formed--.
Col. 2, line 52, change "beformable" to --performable--.
Col. 4, line 10, delete the last occurrence of "the".
Col. 4, line 21, change "and" to --an--.

Signed and Sealed this

Third Day of April, 2001

*Attest:*

Nicholas P. Godici

NICHOLAS P. GODICI

*Attesting Officer*

*Acting Director of the United States Patent and Trademark Office*